US006186276B1

(12) United States Patent
Harbers, Jr.

(10) Patent No.: US 6,186,276 B1
(45) Date of Patent: Feb. 13, 2001

(54) BELAY APPARATUS

(75) Inventor: Henry C. Harbers, Jr., Templeton, CA (US)

(73) Assignee: Atoll Holdings, Inc., San Luis Obispo, CA (US)

( * ) Notice: Under 35 U.S.C. 154(b), the term of this patent shall be extended for 0 days.

(21) Appl. No.: 09/561,311

(22) Filed: Apr. 28, 2000

Related U.S. Application Data

(63) Continuation of application No. 09/126,652, filed on Jul. 31, 1998.

(51) Int. Cl.[7] ..... A62B 35/00
(52) U.S. Cl. ..... 182/231; 182/7
(58) Field of Search ..... 182/231, 236, 182/7

(56) References Cited

U.S. PATENT DOCUMENTS

| | | | | |
|---|---|---|---|---|
| 421,115 | | 2/1890 | Taylor et al. . | |
| 441,819 | * | 12/1890 | Bresnahan | 182/236 |
| 662,243 | * | 11/1900 | Nelson | 182/236 |
| 1,113,369 | | 10/1914 | Olson . | |
| 1,123,776 | | 1/1915 | Meyer . | |
| 1,766,566 | * | 6/1930 | Tucker | 182/7 |
| 1,787,651 | * | 1/1931 | Zwink . | |
| 4,039,045 | | 8/1977 | Hoger . | |
| 4,645,034 | | 2/1987 | Griffith . | |
| 4,679,656 | | 7/1987 | Lew et al. . | |
| 4,941,548 | | 7/1990 | Blanchard . | |
| 4,997,064 | * | 3/1991 | Motte et al. | 182/231 |
| 5,186,275 | | 2/1993 | Bajin . | |

* cited by examiner

*Primary Examiner*—Alvin Chin-Shue
(74) *Attorney, Agent, or Firm*—William W. Haefliger

(57) ABSTRACT

Apparatus for use in controlling vertical movement of a first weight, comprises a first element rotatable in one direction about an axis and blocked against rotation in the opposite rotary direction; a second element acting as a guide; a control weight; and lines supporting the first weight and control weight by the elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight. In addition, the control weight is usable to exert force acting to remove slack from the second line, which is important for safety reasons, where the apparatus is used for climbing.

1 Claim, 4 Drawing Sheets

BELAY APPARATUS

Figure 1:
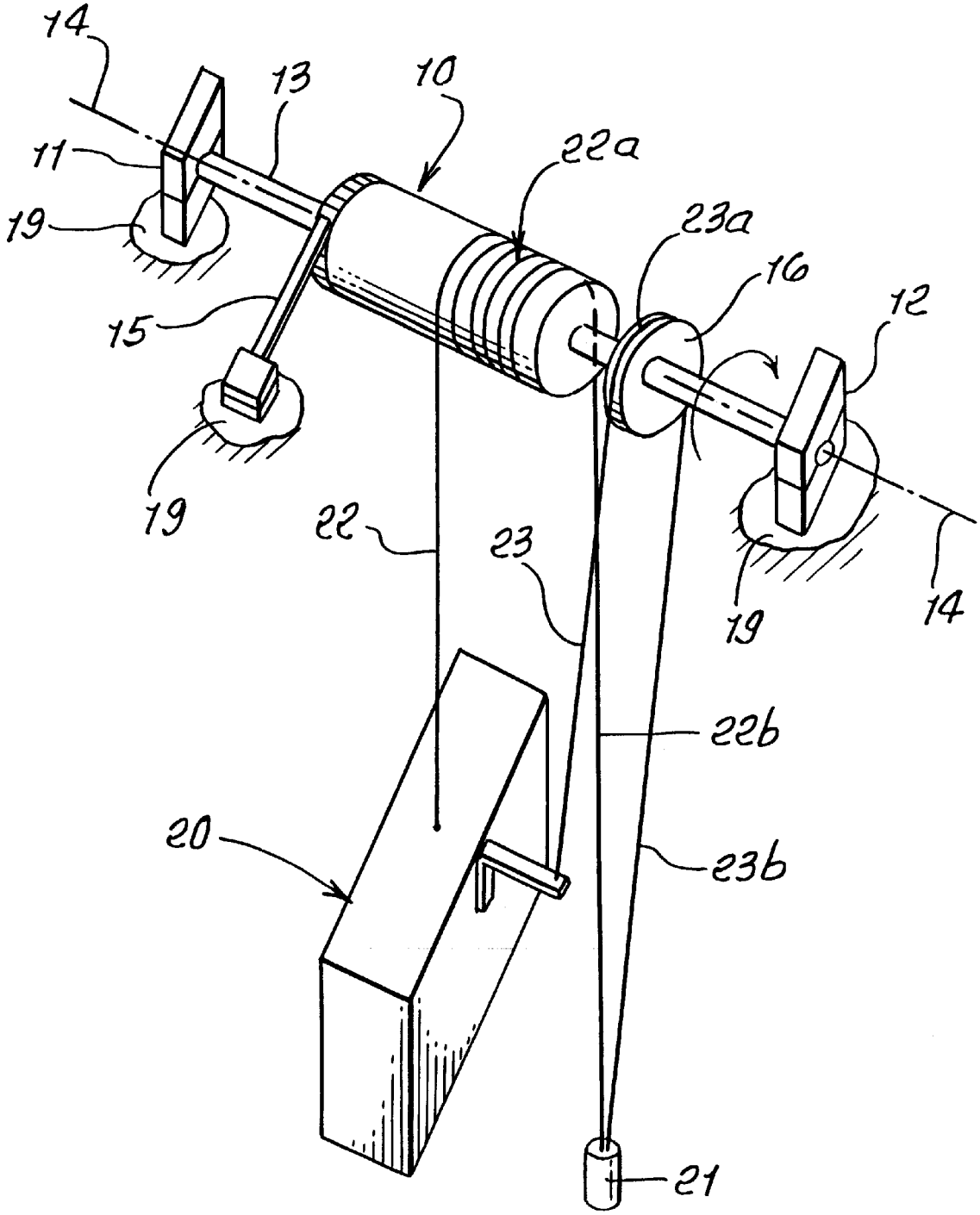

This application is a continuation of Ser. No. 09/126,652 filed Jul. 31, 1998.

BACKGROUND OF THE INVENTION

This invention relates generally to automatic belay apparatus and its use; and more particularly it concerns the provision of safe, easily used, simple and compact, fall protection/lowering apparatus which can be employed in many situations to save lives and also for recreational purposes.

There is a known phenomenon that when a rope is wrapped around a fixed cylinder an X tension is applied to one end of the rope, a reactive force less than X (we will call Y) will stop the rope from slipping. More wraps around the cylinder will reduce the required Y force necessary for equilibrium.

Once equilibrium is attained between X and Y, reducing Y force by some A amount will allow the rope to slip. The amount of reduction in Y is dependent upon, among other things, the elasticity of the rope, the number of wraps around the cylinder, the diameter of the cylinder, and the co-efficient of friction between the rope and the cylinder.

To belay in nautical terms, is to "make fast (a rope) by winding on a cleat or pin".

If one is climbing, to be belayed is to be protected (by a rope) from falling. This is accomplished by wrapping a rope around the belayer, or some other object, so as to reduce the Y tension when a climber falls, creating X tension. The governing equation depicting this phenomenon is:

$$X_{tension}=\theta^{a}FY_{tension}$$

Where $\theta^{a}$=Number of degrees, in radians, that the rope is in contact with a fixed cylinder F=Coefficient of friction between the rope and the cylinder a=Rope coefficient Therefore, the greater number of wraps (radians), the lower Y is required for equilibrium.

And here is the paradox. If one wished Y to be minimal, multiple wraps are required; but, if one wishes to take up slack on the X rope when climbing by taking up Y tension, the weight of the rope X will be multiplied by the same factor (but in reverse) as when the climber falls which might make it impossible to take up slack, and hence a non-functional device. As one example:

For a wire rope, with 5½ wraps around a 3" pipe (3.5 O.D.),

X=50# and Y=0.12#

Therefore, the amplification factor is 50#/0.12=400# Now, remove the 49# weight leaving a 1# rope and try to pull Y. Y=1#×400=400# to take up slack. This is not possible, or practicable.

Accordingly, there is need for improved apparatus to overcome the above problem so that slack can be automatically taken up while using the multiplying effect of multiple wraps; and there is need for apparatus which can be easily used for safe lowering of weights, as from great heights.

SUMMARY OF THE INVENTION

It is a major object of this invention to provide improved fall protection/lowering apparatus and methods, meeting the above needs. Basically, the apparatus of the invention is used for controlling vertical movement of a first weight (as for example a human being or other load), and comprises:

a) a first rotor rotatable in one direction about an axis and blocked against rotation in the opposite rotary direction, b) a second rotor which is substantially freely rotatable in opposite rotary directions, c) a control weight, d) and lines supporting the first weight and control weight by the rotors, and including a first line wrapping about the first rotor and a second line entraining the second rotor, whereby changes in force exertion on the control weight determine alternative existence of a first mode of operation wherein line slippage relative to the first rotor allows the first weight to descend, and a second mode of operation wherein line non-slippage relative to the first rotor thereby blocks descending of the first weight.

Typically, the first line that wraps about the first rotor has line portions that extend downwardly to support loading imposed by the first weight and control weight, respectively; and the second line that entrains the second rotor also has line portions that extend downwardly to support loading imposed by the first weight and control weight respectively.

Another object is to provide the first rotor with an extended surface to engage multiple, non-interfering wraps of the first line. In this regard, the second rotor may typically comprise a pulley.

A further object is to provide the first rotor with two axially spaced generally conical portions, and a generally cylindrical portion intermediate those conical portions. Typically, the conical portions may have wrap engaging angularities characterized as maintaining the first line wraps free of sidewise interengagement or interference during operation of the apparatus to lower the first weight.

Accordingly, optimum operability and functioning of the first line and first rotor are maintained.

Yet another object is to provide the first rotor with an axial through passage, the second line passing through that passage, whereby a high degree of compactness of the equipment is achieved.

An additional object is to provide support structure for a human being who imposes the first weight in order to be lowered, such support structure defined by an upright strut connected to the line wrapped about the first rotor, and a seating ledge connected to the strut. That ledge may advantageously include at least one folding section having an up-folded position extending generally parallel to the upright stem, and a down-folded position extending generally laterally to seat the human being.

In use, the first rotor, i.e. a cylinder for example, is allowed to rotate freely in one direction (while taking up slack), and prevented from rotating in the opposite direction while resisting a fall. The taking up of slack is accomplished by hanging a weight on the Y reactive side of the cylinder greater than the weight of the rope on the X tension side of the cylinder; hence, in the above one example, Y need only be 1# to take up slack but it is strong enough to resist a 400# load during a fall.

If the device is to be used by a climber, once the climber has climbed he must be able to lower himself. This can be accomplished by attaching a separate control rope to the Y reactive weight, running this control rope over a freely rotating sheave, and then attaching the control rope to the X load. By shortening the control rope, the Y reactive force will be reduced until slippage occurs. Since X and Y will remain the same distance apart during slippage, slippage will continue unabated until the control rope is allowed to lengthen, for example lifted.

These and other objects and advantages of the invention, as well as the details of an illustrative embodiment, will be more fully understood from the following specification and drawings, in which:

DRAWING DESCRIPTION

Figure 2:
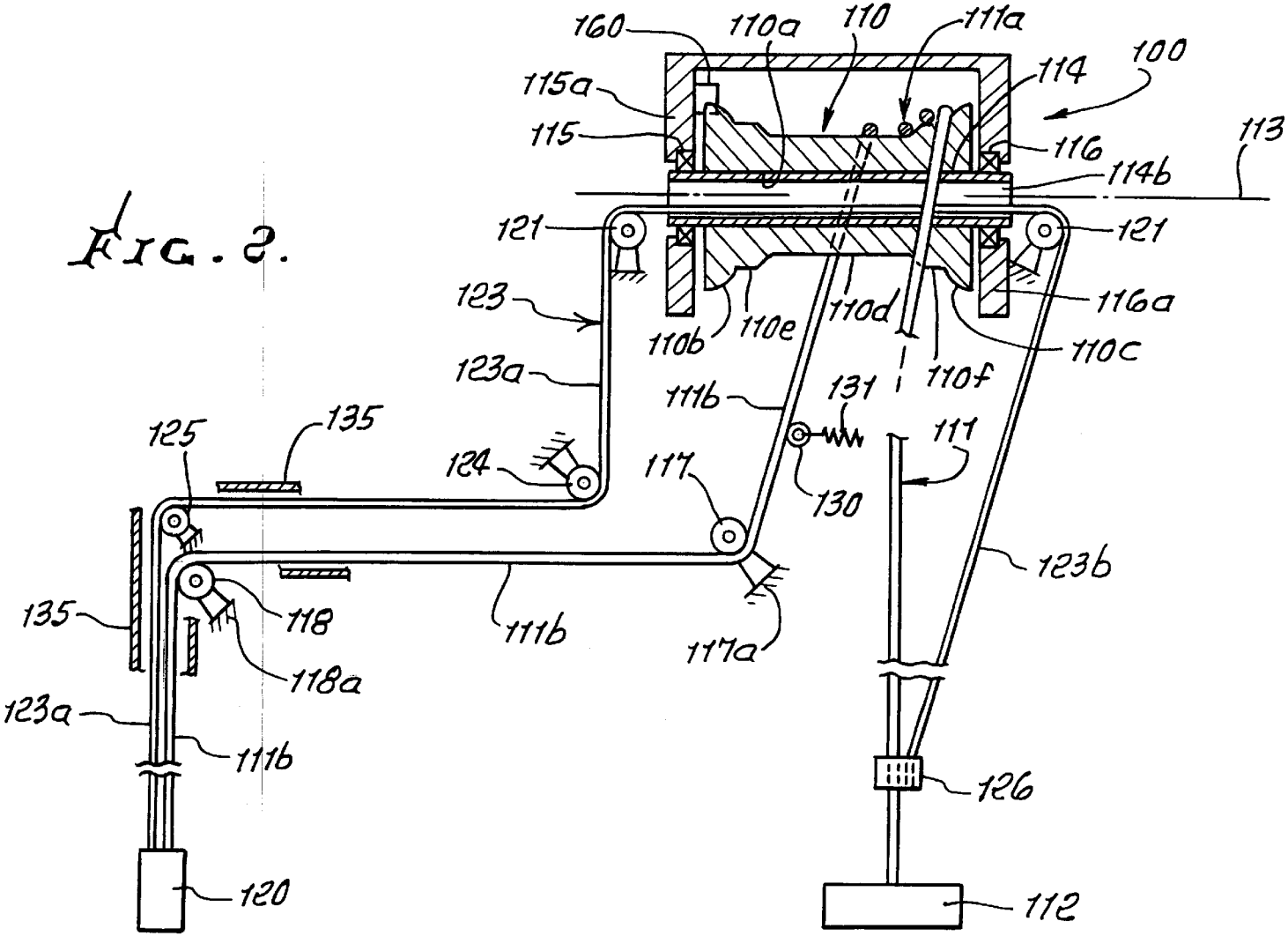
Figure 3:
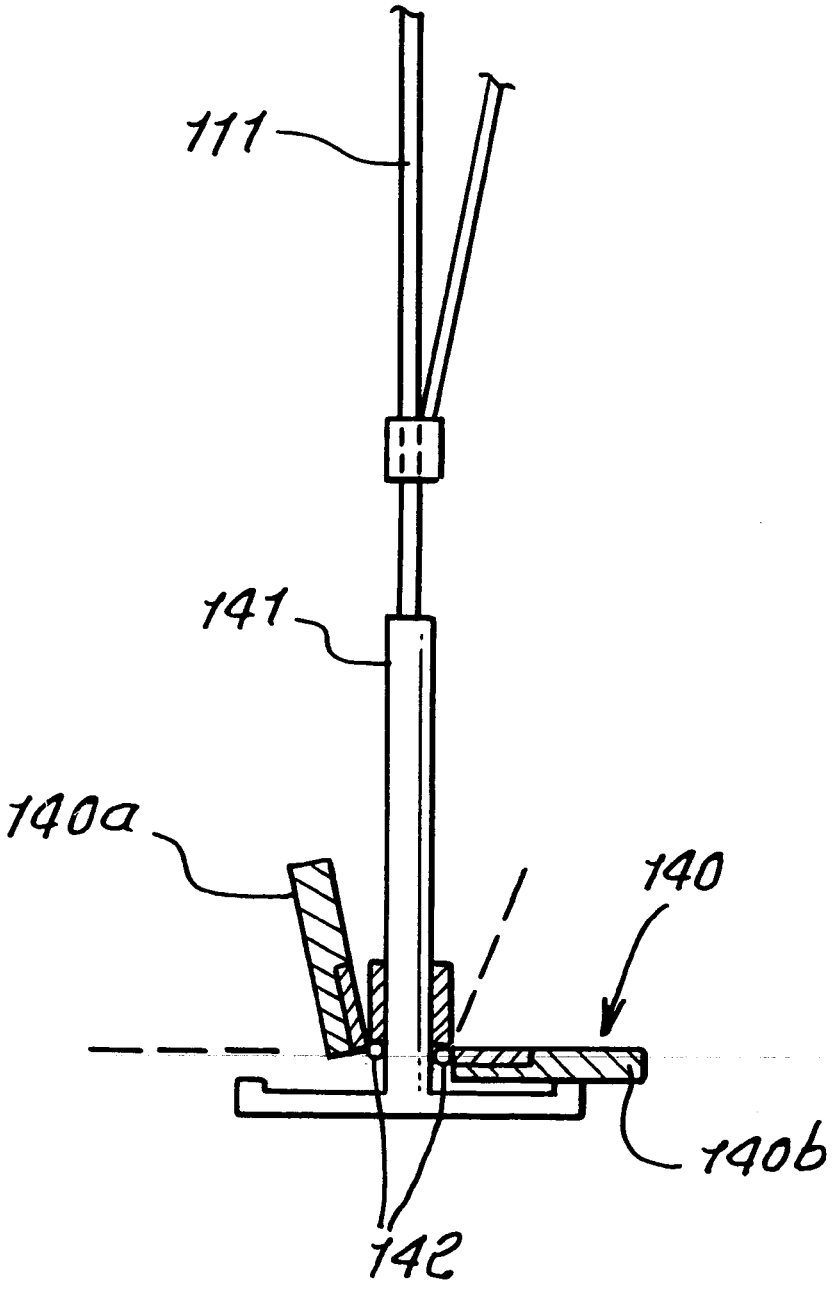
Figure 4:
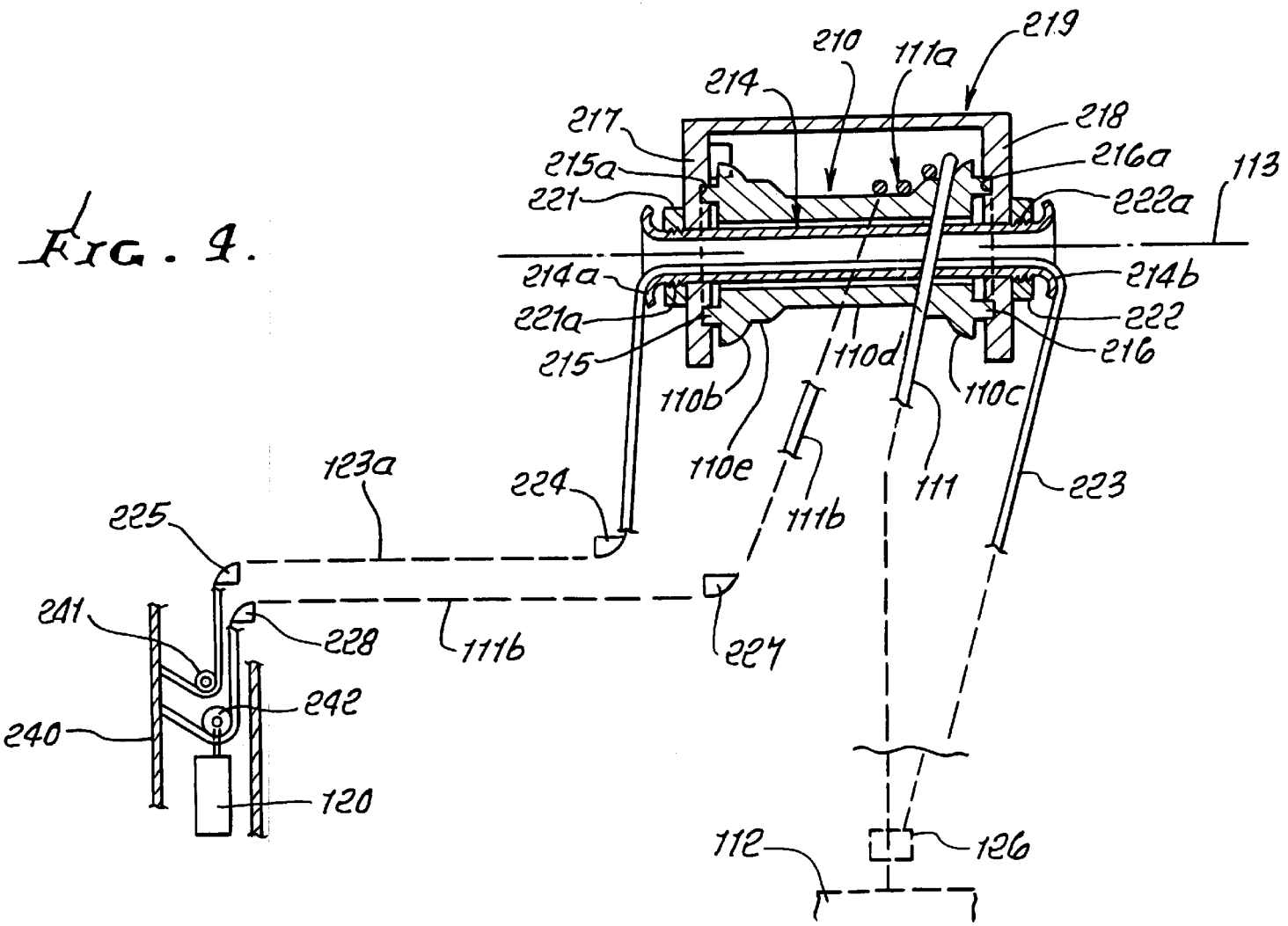

FIG. 1 is a perspective view of apparatus incorporating the invention;

FIG. 2 is an elevation showing modified apparatus incorporating the invention; and FIG. 3 shows a folding seat type support for a human who may wish to climb onto the seat as from a building window, and lower himself, safely, from a height, at the outer side of a building, using the apparatus as described; and FIG. 4 is a view like FIG. 2, but showing further modified apparatus, which is preferred.

DETAILED DESCRIPTION

In FIG. 1, a first load bearing rotor 10 such as a cylinder, is rotatable in one direction (clockwise, for example) but is blocked against rotation in the opposite rotary direction (counter-clockwise, as shown). Suitable bearing supports are shown at 11 and 12, to support the axle 13 supporting the rotor, and extending in the axial direction indicated at 14. A device to block counter-clockwise rotation may take the form of a ratchet arm 15 engaging ratchet teeth on the rotor. A suitable frame 19 supports 11, 12 and 15. Frame 19 may for example be attached to the outer side of a building.

A second rotor 16, such as a sheave or pulley, is supported to be freely rotatable in opposite directions about an axis. In the example, the rotor 16 may be carried by axle 13 to be freely rotatable about axis 14.

Two weights are supported by the two rotors. These include a first weight 20 and a control or reaction weight 21, the weights in this example hanging from the rotors, as via supporting lines. These include a first line 22 supporting first weight 20 and wrapping about the rotor at wrap locations 22*a* at which each turn of the wrap engages the rotor surface, line 22 then extending downwardly at 22*b* to assist in supporting the control weight 21. The lines also include a second line 23 extending downwardly toward the first weight 20, and also extraining the sheave at location 23*a*; line 23 then extends downwardly at 23*b* to assist in supporting the control weight 21.

Changes in force exertion determine alternative existence of a first mode of operation wherein line slippage relative to the first rotor allows the first weight to descend, and a second mode of operation wherein line non-slippage relative to the first rotor thereby blocks descending of the first weight.

By "shortening" the line 23 (for example by manually lifting line 23*b*) reactive force is reduced, until slippage of line 22 occurs at the wrap locations 22*a*, and slippage will continue, accompanied by lowering of first weight 20, until line 23*b* is allowed to "lengthen", i.e. eliminating or reducing manual lifting of line 23. Note that lines 22 and 23, near the weight 20, travel downwardly together during such slippage. Slippage at the wrap locations is prevented by friction, when the line 23 is "lengthened".

Table A below indicates that, depending upon the type of line (such as rope) and, the amount of weight "removed" as by lifting line 23*b* to allow slippage is affected by the number of wraps. (These results are results obtained for a selected set of rotors.)

TABLE A

| | | Auto-Belayer Test | | | |
|---|---|---|---|---|---|
| Wraps | Material | X | Y | ^ | T |
| Wraps = 5 ½ | | | | | |
| | Wire Rope | 50 | .12 | .12 | 1.31 sec. |
| | Sisal | 50 | .36 | .24 | 4.37 sec. |
| | Nylon | 50 | .98 | .48 | 9.50 sec. |
| Wraps = 4 ½ | | | | | |
| | Wire Rope | 50 | .96 | .48 | .90 sec. |
| | Sisal | 50 | .96 | .24 | 3.00 sec. |
| | Nylon | 50 | 1.20 | .24 | 1.38 sec. |
| Wraps = 3 ½ | | | | | |
| | Wire Rope | 50 | 1.44 | .48 | .40 sec. |
| | Sisal | 50 | 2.28 | .84 | 1.55 sec. |
| | Nylon | 50 | 3.41 | .48 | .38 sec. |
| Wraps = 2 ½ | | | | | |
| | Wire Rope | 50 | 4.18 | 1.5 | Fast |
| | Sisal | 50 | 6.0 | 2.3 | Fast |
| | Nylon | 50 | 7.11 | .50 | Fast |
| Wraps = 1 ½ | | | | | |
| | Wire Rope | 50 | 13.82 | 5.00 | Fast |
| | Sisal | 50 | 11.8 | 3.5 | Fast |
| | Nylon | 50 | 16.22 | 2.00 | Fast |
| Wraps = ½ | | | | | |
| | Wire Rope | 50 | 33.13 | 7.00 | Fast |
| | Sisal | 50 | 22.09 | 3.5 | Fast |
| | Nylon | 50 | 33.51 | 3.00 | Fast |
| Wraps = 5 ½ | | | | | |
| | Nylon | 50 | .48 | .48 | very slow movement |
| Wraps = 4 ½ | | | | | |
| | Nylon | 50 | 1.20 | .24 | very slow movement |
| | Nylon | 50 | 1.20 | 1.08 | 5 seconds per foot |
| | Nylon | 50 | 1.20 | 1.20 | 1 second per foot |

3.5" Steel Shaft
3/32" Wire Rope (1000 lb. cap.) weighing 0.015 lbs per foot.
¼" Twisted Sisal Rope (45 lb. Working load Limit) weighing 0.015 lbs. per foot.
¼" Twisted Nylon Rope (124 lb. Working Load Limit) weighing 0.012 lbs. per foot.
X = 50 lb. load.
Y = Weight to just Balance Load.
^ = Amount of Weight removed from Y to allow slippage.
Wraps = Number of times the Material is around the Steel Shaft.
T = Time to fall 20" when Y made 0.0 lbs.

The following are four important features:

1. Increasing wraps around a cylinder will non-linearly increase the force amplification until it eventually reaches an asymptotic limit.

2. To take up slack, the cylinder must rotate in one direction while, acting as a force amplifier, it cannot be allowed to rotate in the opposite direction.

3. The type of rope combined with the number of wraps affects the lowering sensitivity.

4. A deadweight in series with the device on the Y reactive side can act to both protect the climber from a fall and control the rate of his descent.

Referring now to FIG. 2, showing modified and preferred apparatus 100, it includes a modified first rotor 110 about which a cable or line 111 is wrapped via multiple turns, at 111*a*. Line 111 extends downwardly to support a first weight 112 and may be operatively connected to the weight. The rotor 110 is shown as rotatable about a horizontal axis 113. The rotor has a through bore 110*a* through which a cylindrical duct 114 extends. The duct projects at opposite ends of the rotor and which may be supported by bearings 115 and 116 to allow free rotation of the rotor and duct about axis 113. Those bearings are carried by fixed walls 115*a* and 116*a*.

The opposite end extent 111*b* of line or cable 111 extends downwardly to a freely hanging control weight 120. The line 111*b* is shown as turned by pulleys or idlers 117 and 118, as shown, whereby control weight 120 may be located remotely from the weight 112. Fixed structure 117*a* and 118*a* supports the idlers.

A second rotor or rotors 121 is or are shown, as at the end or ends of the duct 114. A second cable or line 123 entrains the rotor or rotors 121. One end portion 123*a* of line 123 extends to control weight 120, and is turned via idlers 124 and 125 as shown. The opposite end portion 123*b* of the line 123 extends downwardly toward weight 112. Since the line 123 slidably extends through the interior 114*b* of the duct 114, and therefore through windings 111*a*, a very compact and simple assembly is provided, with lines 111 and 123*b* extending close to one another and almost directly downwardly toward the weight 112; also line extents 123*a* and 111*b* may extend close together toward the remotely located control weight, and within a protective duct 140, to shield lines 111 and 123*b* from the weather.

Raising or lowering of the line extent 123*b*, as via a control sleeve 126 extending about line 111 in proximity to weight 112, controls the rate of descent of the weight 112, as via control of control weight application to line extent 111*b*. Such control variations control the friction forces exerted by the multiple wraps at 111*a* on the surface of the rotor 110, which in turn controls the slippage rate. A ratchet is indicated at 160, for preventing reverse rotation of the rotor 110.

For enhanced control of such slippage, the first rotor 110 may be provided with two axially spaced generally conical surface portions 110*b* and 110*c*, and a generally cylindrical surface portion 110*d* intermediate the conical portions. The conical portions are interrupted by short cylindrical lands shown at 110*e* and 110*f*. It is found that such configurations serve to maintain the multiple wraps axially separated sufficiently as to avoid development of side-by-side rubbing of the multiple wraps. Such rubbing would otherwise interfere with accurate control of slippage of the wraps on the rotor. A means may be provided to urge line 111 leftwardly, to additionally assist in keeping the turns from side-by-side rubbing. Such means may comprise an idler 130 urged leftwardly as by a spring 131. Raising of weight 112 is associated with take-up of slack in line 123*b*, the importance of which is explained later, especially for safe climbing purposes.

A support may be provided for the weight 112 referred to, that support connected to at least one of the first and second lines. FIG. 3 shows the support in the form of a ledge 140 to seat a weight such as a human being. An upright strut 141 is connected to the ledge, and line 111 is shown connected to the strut. Ledge 140 is shown as including left and right sections 140*a* and 140*b* pivoted to the strut at 142, as by hinges. Accordingly, the seating sections 140*a* and 140*b* may be swung down to the section position 140*b* shown at such time as a human is to step onto the support to controllably and safely descend from a height, as at the outer side of a building, to escape from fire.

The rotors 121 may be non-rotary guides for line 123; and the bore of tube 114 may also or alternatively act as a line guide.

In the preferred apparatus of FIG. 4, the elements that remain the same as those in FIG. 2 carry the same identifying numerals. The rotor 210 (like rotor 110) has annular flanges 215 and 216 at its opposite ends, and which are received in annular grooves 215*a* and 216*b* in the fixed walls 217 and 218 of the frame 219. Those flanges or tongues rotate in the grooves about axis 113 as the rotor rotates, with loading transferred from rotor 210 to walls 217 and 218 via annular bearing surfaces provided at 215 and 215*a*, and at 216 and 216*a*. Surfaces 110*b*, 110*c*, 110*d* and 110*e* are the same as in FIG. 2, as are the line 111, wrappings at 111*a*, and line extent 111*b*.

Duct 214 is non-rotatable, and has its opposite ends clamped, via nuts 221 and 222 to the fixed walls 217 and 218. Those nuts have screw threaded attachment at 221*a* and 222*a* to the duct. Duct 214 serves as a guide or guide duct for the line 223 passing through the duct, i.e. through windings 111*a*. The opposite end interior surfaces 214*a* and 214*b* are flared or turned, as shown, to act as slide guides for the line 223, to turn that line as shown, thereby eliminating need for the pulleys 121 as seen in FIG. 2. See also fixed, non rotary guides for the lines, at 224, 227, 228, and 225.

Protective duct 240 shields lines 123*b* and 111*b* from the weather. Pulleys 240 and 241 are carried by the control weight 220, to turn lines 123*a* and 111*b*, as shown, the ends of those lines being attached to 240. Therefore, weight 120 need only travel one half the vertical distance at it travels in FIG. 2, as weight 112 is lowered; and as it is raised. Raising of weight 112 is associated with lowering of control weight 120, which serves to take up slack in control line portions 123, 123*a* and 123*b*. This is important for example where the weight 112 is a human climber, climbing a wall or rock face, whereby he may use non-slack line 123*b* to control or stop a fall, immediately.

I claim:

1. Apparatus used in controlling vertical downward movement of a first weight, comprising:

a) a first element rotatable in one direction about an axis and a structure blocking said first element against rotation in the opposite rotary direction, b) a second element acting as a guide, c) a control weight, d) and lines supporting said first weight and control weight by said elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight, e) and wherein i) the first line that wraps about the first element has line portions that extend downwardly to support loading imposed by the first weight and control weight, respectively ii) the second line that entrains the second element hag one line portion that extends downwardly to support control loading imposed proximate but independently of the first weight, said one line portion disconnected from the first weight, but extending adjacent to the first line, and another line portion to support loading imposed by the control weight.

* * * * *